US008164530B2

(12) United States Patent
Rhodes et al.

(10) Patent No.: US 8,164,530 B2
(45) Date of Patent: Apr. 24, 2012

(54) ANTENNA FORMED OF MULTIPLE RESONANT LOOPS

(75) Inventors: Mark Rhodes, West Lothian (GB); Brendan Hyland, Edinburgh (GB)

(73) Assignee: WFS Technologies Ltd., Edinburgh (GB)

( * ) Notice: Subject to any disclaimer, the term of this patent is extended or adjusted under 35 U.S.C. 154(b) by 503 days.

(21) Appl. No.: 12/337,985

(22) Filed: Dec. 18, 2008

(65) Prior Publication Data

US 2009/0160723 A1 Jun. 25, 2009

Related U.S. Application Data

(60) Provisional application No. 61/014,780, filed on Dec. 19, 2007.

(30) Foreign Application Priority Data

Dec. 19, 2007 (GB) ..... 0724692.9

(51) Int. Cl.
*H01Q 11/12* (2006.01)

(52) U.S. Cl. ..... 343/742; 343/744; 343/855; 343/866; 343/867; 343/750; 343/709

(58) Field of Classification Search ..... 343/741, 343/742, 744, 748, 855, 866, 867, 850, 788, 343/750, 709; 340/572.7
See application file for complete search history.

(56) References Cited

U.S. PATENT DOCUMENTS

| | | | | |
|---|---|---|---|---|
| 3,626,418 | A | 12/1971 | Berryman | 343/742 |
| 4,518,965 | A | 5/1985 | Hidaka | 343/742 |
| 5,557,293 | A | 9/1996 | McCoy et al. | 343/867 |
| 6,016,129 | A * | 1/2000 | Lauper | 343/867 |
| 7,259,726 | B2 * | 8/2007 | Ibi et al. | 343/867 |
| 7,432,723 | B2 * | 10/2008 | Ellis et al. | 324/654 |
| 7,541,930 | B2 * | 6/2009 | Saarisalo et al. | 340/572.7 |
| 2003/0135326 | A1 * | 7/2003 | Brown | 701/213 |
| 2006/0262028 | A1 * | 11/2006 | Takei | 343/850 |

FOREIGN PATENT DOCUMENTS

| | | |
|---|---|---|
| GB | 1307648 | 2/1973 |
| WO | WO97/27645 | 7/1997 |

* cited by examiner

*Primary Examiner* — Dieu H Duong
(74) *Attorney, Agent, or Firm* — Paul Davis; Goodwin Procter LLP

(57) ABSTRACT

A magnetic and/or magneto-electric antenna that has a plurality of conducting loops where each individual loop can be resonated at a frequency that is offset from the frequency of the other loops to provide a composite band-pass response that is broader than that of the individual loops. A receiving circuit acts to sum the signals from each of the antennas to provide a combined frequency response that is broader in bandwidth than any of the individual loops. Similarly a combination of multiple transmitter loops where a transmit circuit drives a common transmit waveform to each of the combined antennas to provide a combined transmitter frequency response that is broader in bandwidth than any of the individual loops.

17 Claims, 4 Drawing Sheets

ANTENNA FORMED OF MULTIPLE RESONANT LOOPS

CROSS-REFERENCE TO RELATED APPLICATIONS

This application claims the benefit of U.S. Ser. No. 61/014780 filed Dec. 19, 2007, and GB 0724692.9 filed Dec. 19, 2007, both of which applications are fully incorporated herein by reference.

INTRODUCTION

The present invention relates to electromagnetic and/or magneto-inductive antennas formed of multiple separate conducting loops, which are resonantly tuned over a range of frequencies to provide increased composite antenna bandwidth.

BACKGROUND

Magnetic loop antennas have a number of applications, including incorporation as parts of transmitting and receiving systems for communications, and are particularly applicable to methods of communication underwater using electromagnetic and/or magneto-inductive means. Because water, especially seawater, is partially conductive, relatively low signal frequencies are commonly employed in communication systems underwater in order to reduce signal attenuation as much as possible. To this end, antennas in most applications are generally formed of conducting loops.

In a loop antenna forming part of a transmitter system it can be advantageous to increase current in the transmit loop so that the magnetic moment (or field strength) of the resultant transmitted electromagnetic signal is increased. Because a coiled transmit loop exhibits inductance, one way of achieving this is to make the transmit loop the inductive component of an electrically resonant tuned circuit. The other complementary component required to achieve resonance may conveniently be a capacitor connected in series with the inductive loop.

Similarly, it can be advantageous in a loop antenna used as part of a receiver system to maximise the voltage created across the output terminals of a receive loop antenna thereby optimising the signal passed to following receive circuits for detection and processing. In comparable alternative designs, receive signal current may be maximised. In either case, this also can be achieved by making the loop the inductive component of an electrically resonant tuned circuit. A capacitor connected in series with the inductive loop will act to maximise loop current while a parallel-connected capacitor maximises voltage induced across the resonant circuit.

SUMMARY OF THE INVENTION

According to one aspect of the present invention, there are provided multiple loop antennas, each resonated at a frequency offset from the frequency of the others and combined to form a composite antenna system. A receiving circuit acts to sum the signals from each of the antennas to provide a combined frequency response that is broader in bandwidth than any of the individual loops. Similarly a combination of multiple transmitter loops where a transmit circuit drives a common transmit waveform to each of the combined antennas to provide a combined transmitter frequency response that is broader in bandwidth than any of the individual loops.

In the most straightforward implementation each loop is resonated in isolation and the loops are deployed with a physical separation that ensures minimal electromagnetic coupling between the antennas so their composite frequency response is simply a sum of the individual elements. However, in many applications, particularly in portable system, this arrangement will result in unacceptably large antenna array dimensions. In these cases the loop separation may be decreased until a degree of coupling is seen between the loops. This will modify the composite frequency response and the resonating components may be adjusted to achieve the desired summed frequency characteristics.

According to another aspect of the present invention, two related loops of the antenna are deployed so that their mutual physical disposition provides a controlled degree of electromagnetic coupling. In practice this can be arranged conveniently by spacing apart two circular loops on the same axis so that a proportion of the magnetic flux through one loop also passes through the other and vice versa. However, other means of coupling are possible. This method of coupling is particularly convenient because it is inherently provided when the loops are adjacent, but other physical arrangements of two loops are possible in which the loops are separated and coupled by circuit means familiar to electrical engineers, such as capacitive or resistive connection.

In the case of a transmitting antenna, both loops contribute to the desired magnetic field created by the antenna. The loops are separately brought to resonant frequencies designed to be different when the loops are independent and uncoupled. When such loops have resonant frequencies offset from each other, their combined effect when provided with partial coupling is to create a response to signals that has greater bandwidth than each of the resonant loops independently. If the Q of the loop circuits, their independent resonant frequencies, and their degree of mutual coupling are chosen appropriately, it is possible to design a mutually resonant system with a controlled useful bandwidth and a somewhat uniform response across that bandwidth which is considerably wider than a simple single resonant loop.

Where the antenna is used as part of a transmitter system, the frequency response of the aggregate current is also the frequency response of the magnetic moment created by the current. Hence, this is correspondingly improved. The method of coupled resonant loops may also be adopted in a similar manner for receive antennas.

Although two partially coupled antenna loops may provide satisfactory bandwidth and frequency response in many applications, the principle may be extended to three or more resonant loops all of which are mutually coupled. In this way, but at the expense of greater complexity, a response across the useful bandwidth can be achieved which is still flatter than with just two loops.

Some systems of loop antennas and associated transmitters used for the example purpose of underwater communication are discussed in our co-pending patent application, "Underwater Communication System" PCT/GB2006/002123, the contents of which are incorporated herein by reference. Typical means of implementing and applying magnetic loop antennas are described therein, and not repeated here.

BRIEF DESCRIPTION OF THE DRAWINGS

Various aspects of the invention will now be described by way of example only and with reference to the accompanying drawings, of which.

DETAILED DESCRIPTION OF THE DRAWINGS

The present invention relates to resonant magnetic loop antennas in which two or more partially coupled conductive loops widen the effective signal bandwidth, each resonant circuit having Q defined by selection of the resonating component values.

Figure 1B:
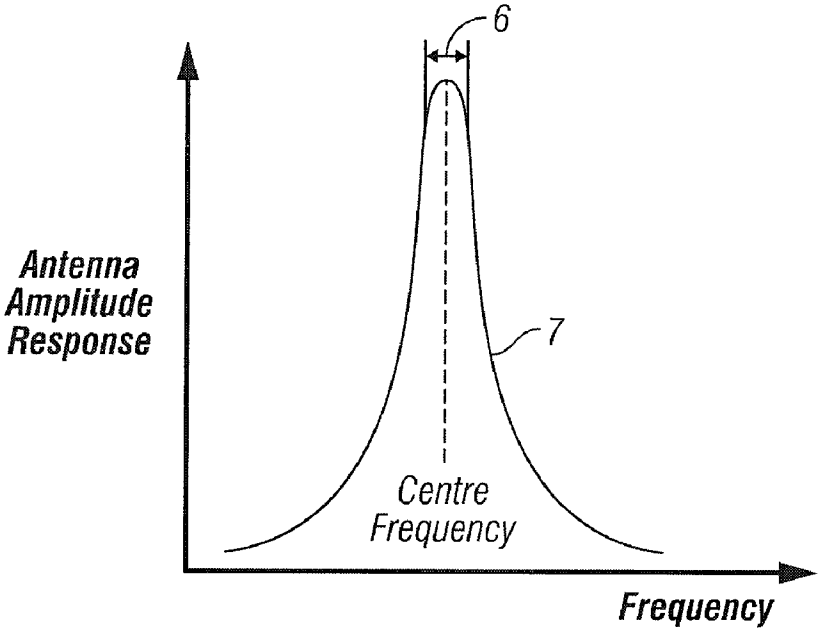
FIG. 1 illustrates a single antenna loop 1 formed of a number of turns of conductor.
Figure 1A:
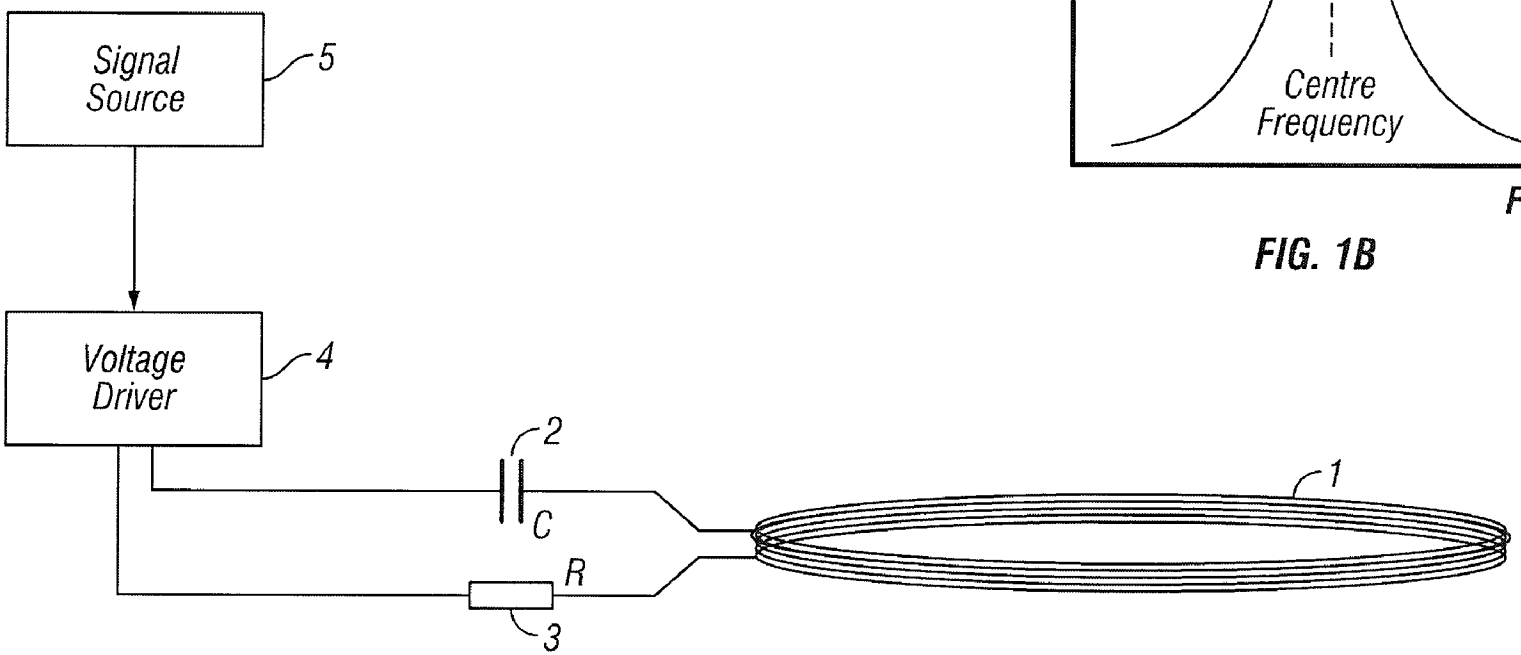

FIG. 1 illustrates a single antenna loop 1 formed of a number of turns of conductor in the usual way that has been brought to series resonance by introduction of the capacitive reactance of capacitor 2 and has its Q restricted by resistor 3. The degree of signal magnification is somewhat proportional to the well-known parameter 'Q' of the resonant circuit, as will be familiar to electrical engineers. The Q is usually defined and determined by the ratio in magnitude of inductive reactance to resistance in the resonant circuit. Some of the resonant circuit resistance may arise inherently from the resistance of the loop conductor but if desired further resistance can be added deliberately by introduction of a known resistor component. An increase of resistance in, for example, a series resonant circuit will decrease the Q and hence increase the bandwidth, but at expense of lesser signal gain.

As is well known, at exactly its resonant frequency the impedance of the combined arrangement of FIG. 1 is reduced to just the value of resistor 3, although the effective value of this resistance may be increased somewhat if the additive inherent resistance (not shown) of the conductor wire is significant. In typical implementations hitherto known, the composite network may be driven by the output of an alternating differential voltage source 4 shown connected to the resonant antenna network, where the nature of the alternating signal and its spectrum are determined in turn by a signal source 5 whose output provides an input to voltage source driver 4.

One difficulty encountered with such resonant antennas is that the wide signal frequency bandwidth, which they would otherwise exhibit, is restricted as a result of the resonant characteristic. A typical signal response and bandwidth of this arrangement is depicted in FIG. 1(*b*) from which it can be seen that the bandwidth 6 likely to be useable about the centre frequency 7 is limited to a relatively narrow range. Not only is the bandwidth limited, but the relative signal attenuation increases rapidly either side of the peak resonant frequency, and with increasingly steep slope away from the centre frequency, so that the useable portion of the frequency spectrum is limited. These characteristics of a simple resonant circuit in other situations will be familiar to electrical engineers.

Such a resonant characteristic of comparatively narrow bandwidth may be acceptable for a signal, which is itself of a narrow bandwidth. However, signals of a narrow bandwidth are of limited utility because inherently they are able to convey information at only a low rate. For useful communication systems, transmission and reception of signals with considerably more bandwidth are usually desirable. This problem is compounded by the necessity of moving to low carrier frequency to reduce the high signal attenuation seen in through water propagation. Reduction in carrier frequency proportionately increases the percentage occupied bandwidth of a fixed signal bandwidth and hence lowers the antenna Q required to effectively carry the signal.

Figure 2:
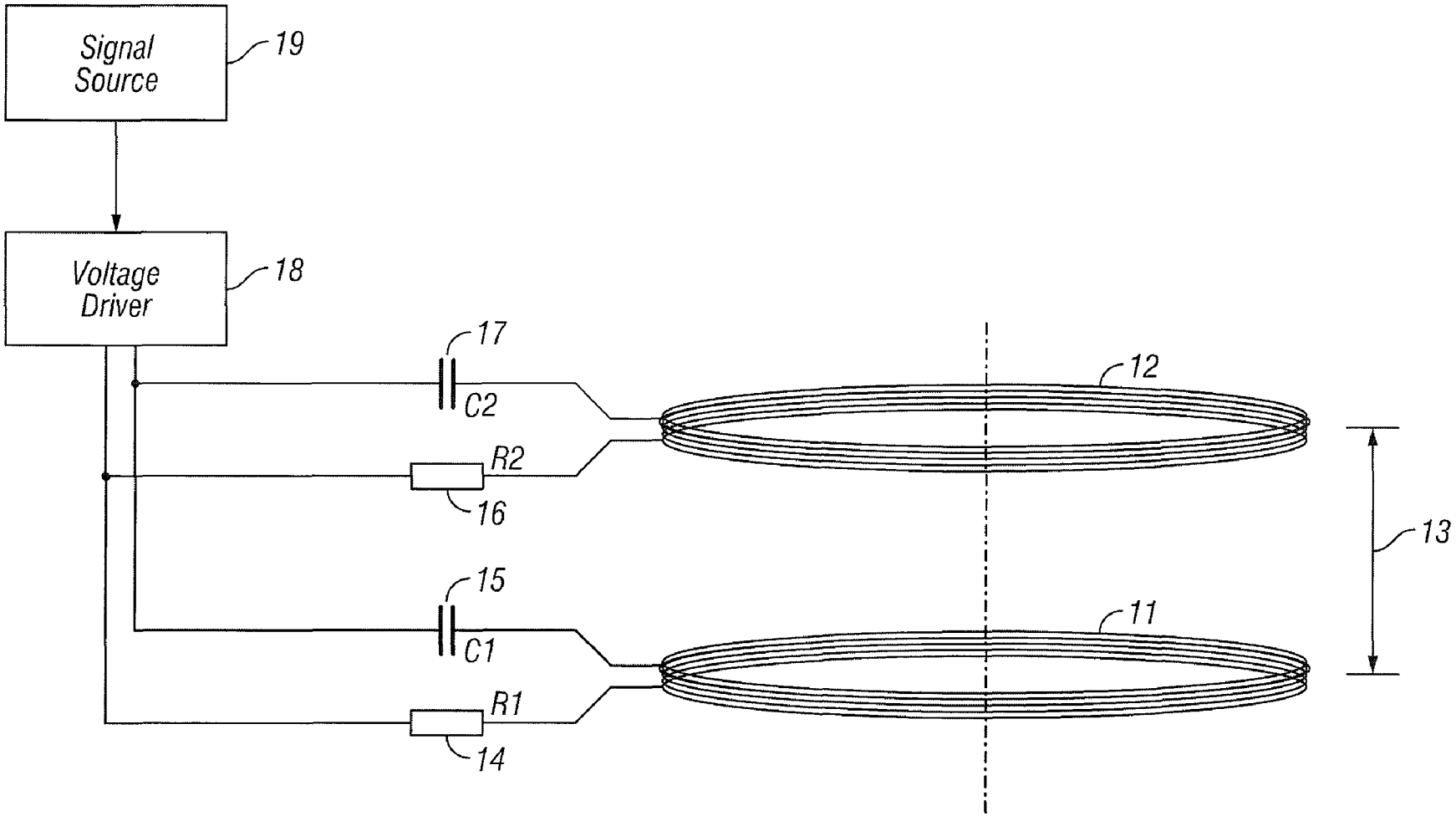
FIG. 2 is a diagram of a transmit antenna comprising two loops partially coupled by virtue of their physical proximity and each brought to series resonance by means of additional capacitors and with their Q values controlled by additional resistors.

FIG. 2 shows a resonant magnetic loop transmit antenna constructed of two electrically conductive loops 11 and 12 physically arranged approximately on the same axis and separated by a controlled distance 13, so that they are partially but not completely coupled by their mutual magnetic flux. Other means of partial coupling are possible but this is usually the simplest. Loop 11 forms a resonant circuit with capacitor 15 and has its Q limited by resistor 14, where this first resonant frequency may be designed slightly lower than the centre of the desired final frequency response of the system. For the transmit antenna arrangement illustrated the resonant components of resistor 14, loop 11 and capacitor 15 are connected in series to maximise current at series resonance. Loop 12 is brought to a resonant frequency by capacitor 17 and has its Q limited by resistor 16, where this second resonant frequency may be arranged to be slightly above the centre of the desired final frequency response of the circuit. For the transmit antenna arrangement illustrated the resonant components of resistor 16, loop 12 and capacitor 17 are connected in series to maximise current at series resonance.

The two resonant frequencies normally should be arranged with approximate symmetry about the desired centre frequency of the desired response, and so as to suit the spectrum of whatever signal is to be transmitted by the antenna. The pair of loop networks may be connected in parallel and driven in similar manner to that described previously by the output of an alternating parallel voltage source 18 shown connected to the pair, where the nature of the alternating signal and its spectrum are determined in turn by a signal source 19 whose output provides an input to voltage source 18. The particular end purpose and application of such an antenna are not part of this invention, so that details of the signal source are not provided here. However, in common applications, the signal source could be a modulated signal required as part of a communication system. Although the network is shown driven by source 18, described as a voltage source, other source impedances may be used provided usual well understood network design principles are taken into account to achieve desired efficiency and spectral response. While this example illustrates a system of two loops, more than two loops will be combined in some applications.

The efficiency of loop antennas generally increases as the area enclosed by the loop increases. Loop dimensions will typically be limited by practical considerations, particularly for portable systems. For these reasons, the individual loops comprising a composite antenna may typically be of substantially equal diameter.

Many applications will apply the techniques described here to achieve a broadened frequency characteristic and with a flat frequency response within an allowable amplitude ripple specification. In these applications each loop will contribute a similar, but frequency shifted, response to its neighbours and hence have a similar requirement for flux coupling with its neighbours. In these applications the loops will beneficially be equally spaced.

The number of turns employed in each loop together with the loop dimensions and wire properties will define the loop inductance, resistance and parasitic capacitance which will impact the resonant Q and the selection of resonating component values. The number of loop turns also impacts the loop antenna efficiency. Following these considerations the number of turns used in each loop within a composite antenna system may vary from loop to loop.

Loop antennas are most efficient as receive antennas when the magnetic flux intersects the loop plane at 90 degrees. In a transmit loop maximum flux is also generated in this vector direction. Because of this directional property, the individual antennas within a composite antenna will typically be arranged with their planes substantially mutually parallel.

Figure 4:
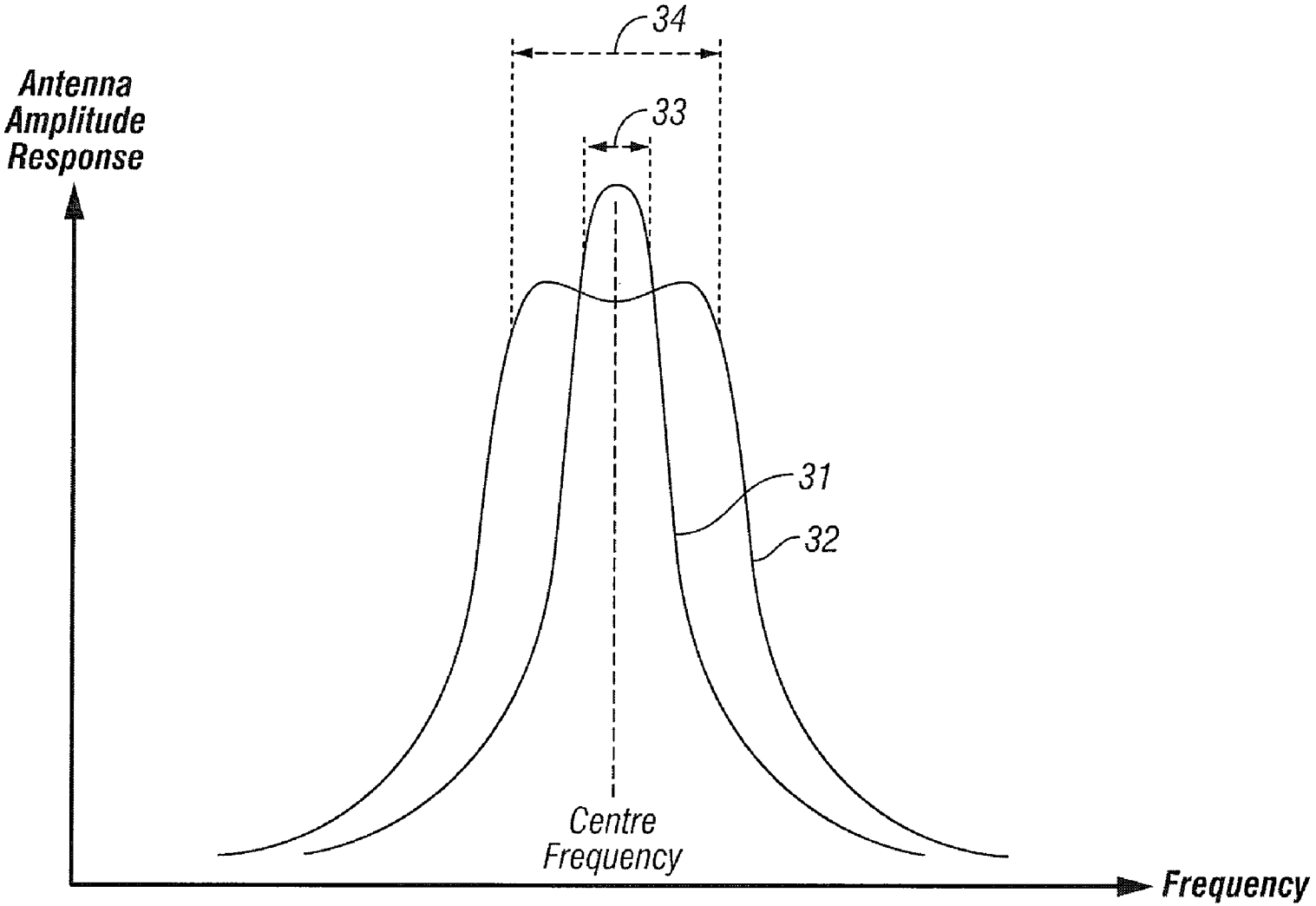
FIG. 4 shows the relative frequency responses firstly of the antenna system of FIG. 1 and secondly of the antenna systems of FIGS. 2 and 3, both superimposed on the same graph.

An example signal response 32 and bandwidth 34 of a typical arrangement according to this invention is depicted as the second of the graphs of FIG. 4. The shape of the response 32 of the aggregate alternating current in the two loops is plotted on the graph with respect to frequency. According to this invention, and in contrast to bandwidth 33 of the single resonant loop, it can be seen that the increased bandwidth 34 provided by this example of two coupled resonant loops is considerably greater. The shape of the frequency response, of which response 32 is typical, may be adjusted somewhat dependent on requirements. Parameters may be changed such as the degree of coupling between the loops, the Q of the resonant loops (which usually will be nominally equal), and the centre frequencies of each of the separate loops. In particular, these changes will allow compromises to be made amongst the parameters of bandwidth, average signal gain within the bandwidth, and flatness of the frequency response within the usable bandwidth.

The number of separate loop antennas required to provide effective coverage of a given bandwidth at a particular centre frequency will be dependent on the acceptable in-band amplitude ripple of the required band-pass characteristic. In one example, loops may be tuned so that their 3 dB bandwidth points coincide to provide a band-pass response with 3 dB in-band ripple.

Electrically insulated loop antenna systems of the type illustrated here will be particularly applicable to underwater radio applications. Water, and especially seawater, is partially electrically conductive and this property results in high attenuation of radio signals that increases with increasing frequency. This consideration leads us to the use of low frequency signals to improve the achievable signalling range. For communications applications the bandwidth a communications signal is intimately linked to its data rate as described by C. E. Shannon (January 1949). "Communication in the presence of noise". Proc. Institute of Radio Engineers vol. 37 (1): 10-21. For this reason underwater radio communications signals are driven to use high percentage bandwidth signals. For many applications wavelength related antenna types will be impractical due to their large dimensions at frequencies in the kHz and MHz regions. Loop antennas as described in this application are often a good choice for underwater applications. The benefits of an electrically insulated loop antenna in underwater applications are described in detail our co-pending patent application, "Underwater Communication System" PCT/GB2006/002123. For these reasons the composite resonated loop antenna system described in this application is particularly beneficial in underwater applications.

The composite frequency response of the combined antenna array may be further tailored by individually adjusting the resonant Q of each loop. For example, the loops tuned at the high end and low end of the frequency band may be tuned to provide a higher Q to increase the rejection roll off at the band edges. As a further refinement, additional loops may be provided as part of an electromagnetically coupled antenna array, which form shorted turns with series resonance tuned to the antenna frequency band edges. These loops will cancel the incident magnetic field at their resonant frequency and hence sharpen the edges of the rejected band. These loops will not be connected to any combinational circuit but contribute through electromagnetic coupling.

Figure 3:
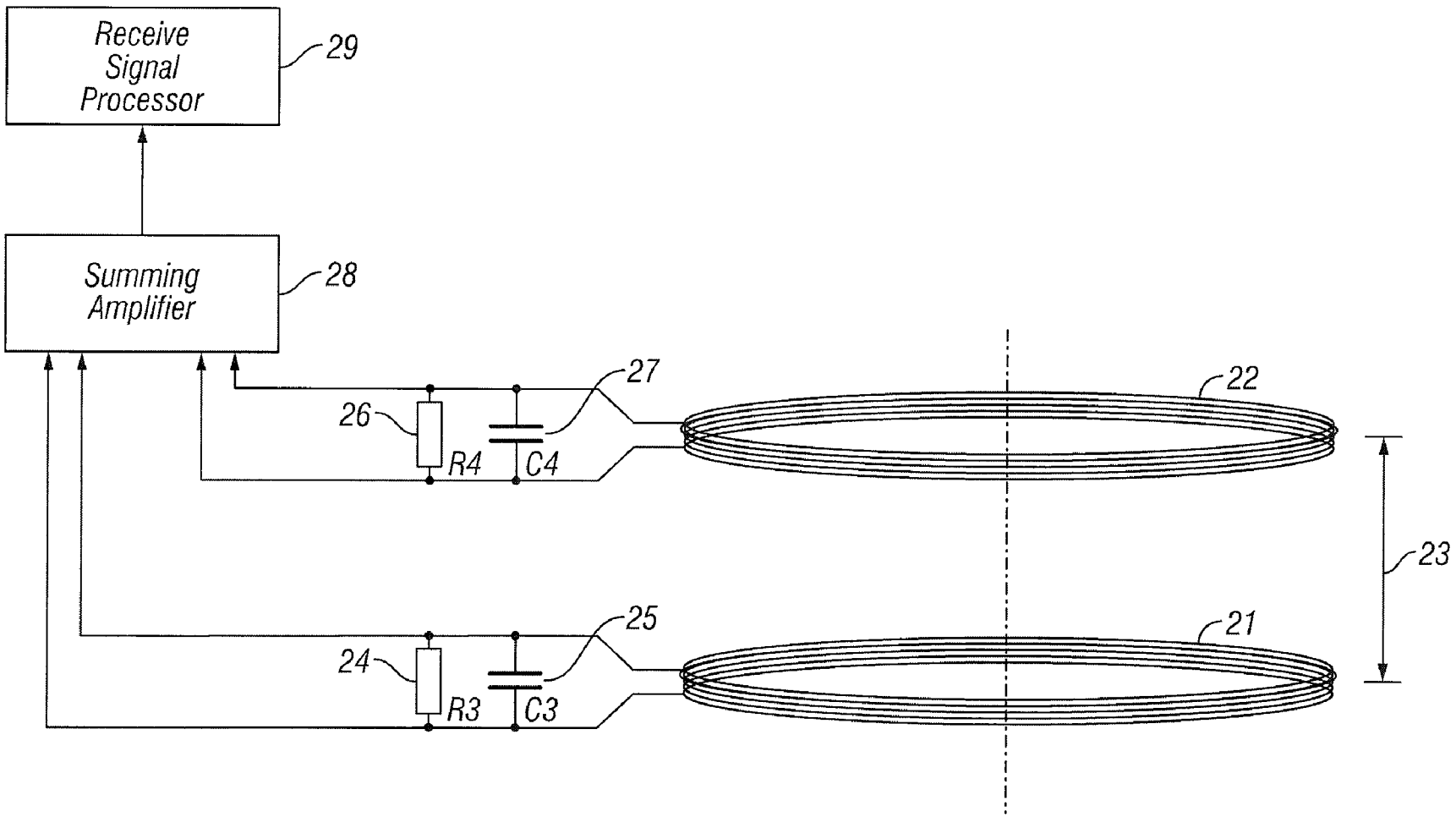
FIG. 3 is a diagram of a receive antenna, analogous to the transmit antenna of FIG. 2, comprising two loops partially coupled by virtue of their physical proximity and each brought to parallel resonance by means of additional capacitors and with their Q values controlled by additional resistors.

The above example implementation of this invention relates typically to aspects of a transmit antenna used as part of an electromagnetic or magneto-inductive system, but a similar and analogous concept may be used in receive antennas designed to receive a signal where bandwidth is of importance. As typically depicted in FIG. 3, each of two receive loops 21, 22 which have partial mutual coupling by virtue of their physical spacing 23 may be brought to resonance by connecting across them respective parallel capacitors 25, 27. To control the Q value of each, respective parallel resistors 24, 26 may be included, where lower values of each resistor will decrease Q due to its parallel connection. Thus two partially coupled parallel tuned circuits are created, and the voltage across each represents a contribution to the combined signal received by the antenna. The voltages are fed to the input of a summing device, which may be a summing amplifier 28. After summation, the aggregate signal can be further conveyed to whatever receive signal processing device 29 may be arranged to handle the signal. Once more, the end purpose and application of such a receive antenna are not a part of this invention, so that details of the signal processing are not provided here. However, a common signal process could be demodulation of a modulated signal required as part of a communication system.

This antenna system may also be applied to a radio navigation system. Radio signals vary over distance in amplitude and phase and these properties have formed the basis of radio navigation systems based on many well-known techniques. The benefits of this antenna system can be usefully applied to various radio navigation applications. This antenna system may also find applications in the field of radio object detection and characterisation. Extended operational bandwidth will benefit a detection system's ability to resolve features in range and may show other operational benefits.

A skilled person will appreciate that variations in implementation and application of the example arrangements according to this invention are possible without departing from the essence of the invention, and other variations which embody coupled loop systems may still derive full or partial advantage from it. Applications of this invention are not limited to communication but may also include other transmit and/or receive systems which require gain and significantly greater bandwidth than can be achieved by a single tuned loop. Nor are the applications limited to underwater operation. Applications above and below water also include but are not limited to navigation systems, direction finding systems and systems for detecting the presence of objects.

The invention claimed is:

1. A magnetic and/or magneto-electric antenna that has a plurality of conducting loops which are in different planes and are partially magnetically coupled with one another, where each individual loop can be resonated at a frequency that is offset from the frequency of the other loops to provide a composite band pass response that is broader than that of said individual loops, the composite band-pass response having frequency band edges, wherein loops within the antenna are connected as shorted turns with series resonance to increase amplitude roll off at the frequency band edges.

2. The antenna according to claim 1 comprising the plurality of conducting loops with mutual coupling where said loops are each part of a resonant electrical circuit.

3. The antenna according to claim 1 wherein coupling between loops is provided by means of a mutual flux path.

4. The antenna according to claim 1 wherein the conducting loops are physically spaced to exhibit negligible mutual coupling where the loops are each part of a resonant electrical circuit.

5. The antenna according to claim 1 arranged to transmit and/or receive a signal.

6. The antenna according to claim 1 wherein coupling between loops is provided partially or wholly by an arrangement that includes one or more capacitor or resistor device.

7. The antenna according to claim 1 that has two or more loops.

8. The antenna according to claim 1 wherein the loops are positioned on substantially the same axis.

9. The antenna according to claim 1 wherein the loops are positioned with their planes substantially parallel.

10. The antenna according to claim 1 wherein the loops have the same diameter.

11. The antenna according to claim 1 wherein the loops each have the same or a different number of turns.

12. The antenna according to claim 1 wherein each loop has a Q factor and the number of loops in a combined antenna and the Q of each loop is arranged to achieve an in-band amplitude ripple.

13. The antenna according to claim 1 wherein each loop antenna has resonating components connected in series for use in a transmitter application.

14. The antenna according to claim 1 wherein each loop antenna has resonating components connected in parallel for use in a receiver application.

15. The antenna according to claim 1 which is incorporated as part of a communication system; a navigation system; a direction finding system; a system for detecting the presence of objects; a system for remotely characterising objects or any combination of the said system.

16. The antenna according to claim 1 wherein the loops are electrically insulated for use in underwater applications.

17. The antenna according to claim 1 which is incorporated as part of an underwater communication system; an underwater navigation system; an underwater direction finding system; an underwater system for detecting the presence of objects; an underwater system for remotely characterising objects or any combination of the said system.

* * * * *